US010837381B2

(12) United States Patent
Ashizawa

(10) Patent No.: US 10,837,381 B2
(45) Date of Patent: Nov. 17, 2020

(54) START CONTROL SYSTEM FOR INTERNAL COMBUSTION ENGINE

(71) Applicant: TOYOTA JIDOSHA KABUSHIKI KAISHA, Toyota (JP)

(72) Inventor: Takeshi Ashizawa, Yokohama (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/572,857

(22) Filed: Sep. 17, 2019

(65) Prior Publication Data

US 2020/0132006 A1 Apr. 30, 2020

(30) Foreign Application Priority Data

Oct. 30, 2018 (JP) ..... 2018-203906

(51) Int. Cl.
*F02P 9/00* (2006.01)
*F02D 41/00* (2006.01)

(52) U.S. Cl.
CPC ..... *F02D 41/0082* (2013.01); *F02P 9/007* (2013.01)

(58) Field of Classification Search
CPC ..... F02D 41/0082; F02P 15/08; F02P 5/1506; F02P 9/007; F02N 19/005
See application file for complete search history.

(56) References Cited

U.S. PATENT DOCUMENTS 4,061,113 A * 12/1977 Beyler ..... F02P 7/03 123/26
4,287,862 A * 9/1981 Noguchi ..... F02B 5/00 123/146.5 A
4,541,367 A * 9/1985 Lindberg ..... F02B 43/08 123/25 F
9,790,879 B2 * 10/2017 Kojima ..... B60K 6/48
9,874,169 B2 * 1/2018 Nagatsu ..... F02D 41/126
9,970,407 B2 * 5/2018 Idicheria ..... F02P 9/007
2009/0126684 A1 * 5/2009 Shiraishi ..... F02D 41/3041 123/406.12
2010/0258097 A1 * 10/2010 Takahashi ..... F01L 13/0026 123/609

(Continued)

FOREIGN PATENT DOCUMENTS

JP 2007-146777 A 6/2007

*Primary Examiner* — David Hamaoui
(74) *Attorney, Agent, or Firm* — Oblon, McClelland, Maier & Neustadt, L.L.P.

(57) ABSTRACT

In the start control, the first and second discharge actions of the ignition apparatuses are controlled. The first discharge action is performed to ignite the mixed gas in the multiple cylinders. The second discharge action is performed to generate the ozone. The first discharge action is performed immediately after the start of the cranking. The first discharge action is performed in the cylinders which belongs to the first and second cylinder groups. The second discharge action is performed before the start of the cranking. The second discharge action is performed in at least one cylinder which belongs to the second cylinder group. The multiple cylinders belong to the first or second cylinder group. The multiple cylinders are classified into the first or second cylinder group based on the crank angle section $S_{CA}$ set for each cylinder.

2 Claims, 4 Drawing Sheets

(56) References Cited

U.S. PATENT DOCUMENTS

| | | | | |
|---|---|---|---|---|
| 2015/0377206 | A1* | 12/2015 | Idicheria | F02D 41/402<br>123/299 |
| 2016/0032873 | A1* | 2/2016 | Eckhardt | F02M 27/06<br>123/568.11 |
| 2020/0132036 | A1* | 4/2020 | Ashizawa | F01N 3/10 |

* cited by examiner

S10:
HAS REQUEST FOR STOP ENGINE ISSUED?
S12:
STOP PISTON OF PREDETERMINED CYLINDER WITHIN CRANK ANGLE SECTION $S_{CA}$
S14:
HAS REQUEST FOR START ENGINE ISSUED?
S16:
IDENTIFY FIRST AND SECOND CYLINDER GROUPS

S18: HAS SPECIFIED TIME ELAPSED?
S20: PERFORM SECOND DISCHARGE IN FIRST CYLINDER GROUP
S22: START CRANKING
S24: PERFORM FIRST DISCHARGE ACTION & FUEL SUPPLY IN EVERY CYLINDER

START CONTROL SYSTEM FOR INTERNAL COMBUSTION ENGINE

CROSS-REFERENCE TO RELATED APPLICATION

The present disclosure claims priority under 35 U.S.C. § 119 to Japanese Patent Application No. 2018-203906, filed on Oct. 30, 2018. The entire contents of the application are incorporated herein by reference in their entirety.

TECHNICAL FIELD

The present disclosure relates to a control system which is applied to a spark-ignited internal combustion engine.

BACKGROUND

JP2007-146777A discloses a controller which is configured to control a spark-ignited internal combustion engine. This controller controls a first and a second discharge actions of an ignition apparatus. The first discharge action is performed to ignite mixed gas in a cylinder. The second discharge action is performed to generate ozone. The second discharge action is performed in an intake stroke of the internal combustion engine. The first discharge action is performed immediately after the second discharge action. When the second discharge action is performed, the ozone is generated in the cylinder. Therefore, when the first discharge action is performed immediately after the second discharge action, combustion state of the cylinder is improved. Note that the fuel which forms the mixed gas is supplied into the cylinder between the first and second discharge actions.

Since the ozone has high reactivity, the combustion state of the cylinder is improved by the second discharge action. Therefore, the prior art mentioned above may be effective for start control of the internal combustion engine in which combustion state in the cylinder is relatively unstable. In other words, when the start control in which the first discharge action is performed immediately after the second discharge action is executed, it is possible to improve the combustion state in the cylinder at the start of the internal combustion engine.

However, when an exhaust action of the internal combustion engine is performed from the second discharge action to the first discharge action, the ozone generated by the second discharge action will be discharged from the cylinder. In other words, the ozone, which should promote the combustion of the mixed gas, will be wasted in association with the discharge from the cylinder. In addition, when such the useless second discharge actions are repeatedly performed, it is undesirable because they would shorten a life of the ignition apparatus.

The present disclosure addresses the problem mentioned above, and one object of the present disclosure is to utilize the ozone, which is generated by the discharge action of the ignition apparatus before the start of the internal combustion engine, for the combustion of the mixed gas in the cylinder without wasting it.

SUMMARY

A first aspect of the present disclosure is a control system for internal combustion engine and has the following features.

The system comprises an internal combustion engine, ignition apparatuses and a controller.

The internal combustion engine comprises multiple cylinders.

The ignition apparatuses are provided to each of the multiple cylinders.

The controller is configured to control discharge actions of the ignition apparatuses for each cylinder.

The discharge actions include a first discharge action for igniting mixed gas in the multiple cylinders and a second discharge action for generating ozone.

The controller is further configured to perform start control of the internal combustion engine.

In the start control, the controller is configured to:

classify the multiple cylinders into a first group or a second cylinder group;

control the ignition apparatus of at least one cylinder of the multiple cylinders which is classified into the first cylinder group such that the second discharge action is not performed before the start of the first discharge action; and control the ignition apparatus of at least one cylinder of the multiple cylinders which is classified into the second cylinder group such that the second discharge action is performed before the start of the first discharge action.

The at least one cylinder which belongs to the first cylinder group is at least one cylinder of the multiple cylinders in which an initial combustion of the mixed gas occurs after passing through a crank angle section which is set on an end side of an exhaust stroke of the same cylinder.

The at least one cylinder which belongs to the second cylinder group is at least one cylinder of the multiple cylinders in which the initial combustion of the mixed gas occurs before passing through a crank angle section which is set on the end side of the exhaust stroke of the same cylinder.

A second aspect of the present disclosure has the following features according to the first aspect.

The system further comprises injectors.

The injectors are configured to supply fuel into each of the multiple cylinders.

The controller is further configured to perform stop control of the internal combustion engine.

In the stop control, the controller is configured to control the ignition apparatus and the injector of a predetermined cylinder of the multiple cylinders such that a piston of the predetermined cylinder stops in a crank angle section which is set on the end side of the exhaust stroke of the predetermined cylinder.

In the start control, the controller is configured to control the ignition apparatus of the predetermined cylinder such that the first discharge action in the predetermined cylinder starts before passing through the crank angle section which is set on the end side of the exhaust stroke of the predetermined cylinder.

According to the first aspect, when the start control is performed, the second discharge action is not performed before the start of the first discharge action in the at least one cylinder which is classified into the first cylinder group. Therefore, in the at least one cylinder which is classified into the first cylinder group, no ozone exists in the same cylinder before the start of the first discharge action. Here, in the at least one cylinder which belongs to the first cylinder group, the initial combustion of the mixed gas occurs after passing through the crank angle section which is set on the end side of the exhaust stroke of the same cylinder. In other words, in the at least one cylinder which belongs to the first cylinder group, the exhaust action is performed before the initial combustion of the mixed gas in the same cylinder. However, in the at least one cylinder which is classified into the first cylinder group, since no ozone exists in the same cylinder, no ozone is discharged by this exhaust action.

On the other hand, in the at least one cylinder which is classified into the second cylinder group, the second discharge action is performed before the start of the first discharge action. Therefore, in the at least one cylinder which is classified into the second cylinder group, the ozone exists in the same cylinder before the start of the first discharge action. Here, in the at least one cylinder which belongs to the second cylinder group, the initial combustion of the mixed gas occurs before passing through the crank angle section which is set on the end side of the exhaust stroke of the same cylinder. In other words, in the at least one cylinder which belongs to the second cylinder group, the exhaust action is performed after the initial combustion of the mixed gas in the same cylinder. Therefore, in the at least one cylinder which is classified into the second cylinder group, the combustion state of the same cylinder is improved by the ozone.

From the above, according to the first aspect, in the at least one cylinder which is classified into the second cylinder group, it is possible to use the ozone, which is generated by the second discharge action performed in the same cylinder, for the combustion of the mixed gas in the same cylinder without wasting it. In addition, it is possible to reduce number of times to drive the ignition apparatus which is driven for the second discharge action. Therefore, it is possible to prevent the life of the ignition apparatus of the at least one cylinder which is classified into the first cylinder group from being shorten.

According to the second aspect, when the stop control is performed, the piston of the predetermined cylinder is stopped within the crank angle section which is set on the end side of the exhaust stroke of the predetermined cylinder. When the start control is performed in addition to the stop control, the first discharge action is started in the predetermined cylinder before passing through the crank angle section which is set on the end side of the exhaust stroke of the predetermined cylinder. When such the stop and start control are performed, the predetermined cylinder is always classified into the second cylinder group. Therefore, it is possible to improve the combustion state of the predetermined cylinder definitely.

DESCRIPTION OF EMBODIMENT

Hereinafter, an embodiment of the present disclosure will be described with reference to the drawings. In each of the drawings, the same or corresponding parts are denoted by the same sign, and the description thereof will be simplified or omitted.

1. Configuration of Control System

Figure 1:
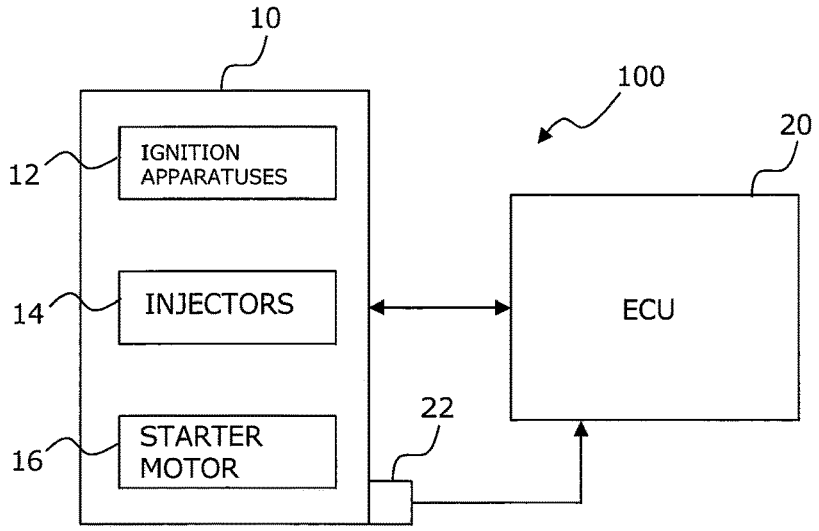
FIG. 1 is a block diagram for explaining a configuration example of a control system according to an embodiment of present disclosure.

The control system according to the embodiment of the present disclosure is applied to an internal combustion engine (hereinafter simply referred to as an "engine") mounted on a vehicle. This engine has multiple cylinders. There is no particular limitation on total number and arrangement of the multiple cylinders. FIG. 1 is a block diagram for explaining a configuration example of the control system. The control system 100 includes an engine 10 and an ECU (Electronic Control Unit) 20. The engine 10 comprises ignition apparatuses 12, injectors 14 and a starter motor 16.

The ignition apparatuses 12 are provided for each cylinders of the engine 10. Each of the ignition apparatuses 12 has an ignition coil and a spark plug. The spark plug has a center electrode and a GND electrode. When the ignition coil is driven, a voltage is applied to the center electrode, and a discharge occurs between the center and GND electrodes.

The voltage applied to the center electrode includes high voltage for ignition and low voltage for ozone generation. The high voltage for ignition is set to a voltage capable of igniting the mixed gas (e.g., 20 kV or more). On the other hand, the voltage for ozone generation is set to a voltage (e.g., less than 5 kV) which is sufficient to generate ozone while being unable to ignite mixed gas.

Similar to the ignition apparatuses 12, the injectors 14 are also provided for each cylinder of the engine 10. The injectors 14 may be of the type that directly inject into the multiple cylinders, or may be of the type that inject to intake ports of the multiple cylinders.

The starter motor 16 is a starting device that cranks the engine 10 at the start of the engine 10. The starter motor 16 has a rotor shaft and an inverter. The rotor shaft transmits power to a crankshaft of the engine 10 via a known mechanism such as a belt mechanism. The inverter is connected to be able to transmit and receive power with the battery.

The ECU 20 is a microcomputer including a processor, a memory, an input interface and an output interface. The ECU 20 functions as a controller of the control system 100. The ECU 20 receives and processes signals from various sensors mounted on the vehicle. The ECU 20 controls various actuators in accordance with predetermined programs based on the signals from the various sensors.

The various sensors include a crank position sensor 22 that outputs a signal according to rotation angle of the crankshaft. The actuators operated by the ECU 20 include the ignition apparatuses 12, the injectors 14 and the starter motor 16.

2. Start Control

2.1 Summery of Start Control

The engine control executed by the ECU 20 includes control for starting the engine 10 (hereinafter also referred to as "start control"). The term "start" here includes not only cold start but also re-start after an automatic stop. In the start control, cranking is started by driving the starter motor 16. Then, immediately after the start of this cranking, the ignition apparatuses 12 and the injectors 14 are driven to burn the mixed gas in the multiple cylinders.

More specifically, when the injectors 14 are driven, the mixed gas is generated in each cylinder. Then, the ignition apparatuses 12 are driven to ignite the mixed gas. When the ignition apparatus 12 is driven to apply the high voltage for ignition to the center electrode, the mixed gas in the cylinder burns and the engine 10 autonomously rotates. Hereinafter, an action to apply the high voltage for ignition to the center electrode once is referred to as a "first discharge action".

In the start control, a second discharge action is performed separately from the first discharge action. The second discharge action is an action to apply the low voltage for ozone generation to the center electrode multiple times. The second discharge action is performed before the start of the cranking. This second discharge action is not performed in the cylinder which belongs to the first cylinder group but is performed in the cylinder which belongs to the second cylinder group.

Figure 2:
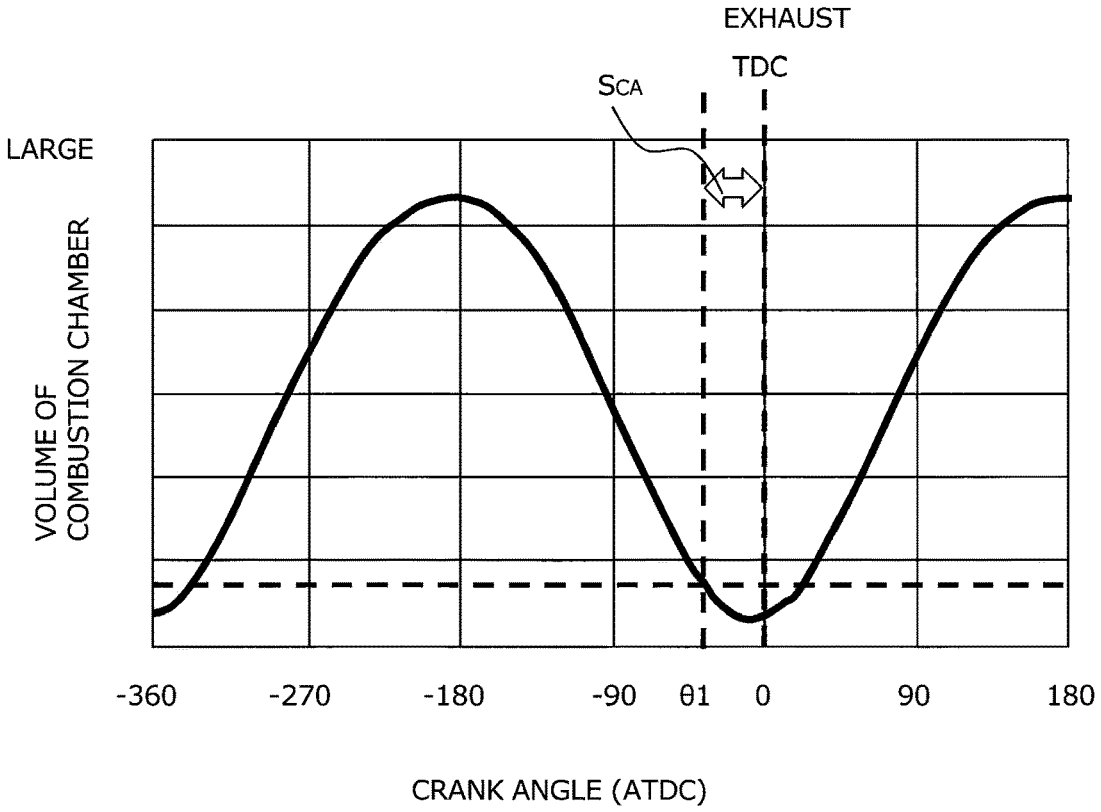
FIG. 2 is a diagram for explaining a crank angle section $S_{CA}$.

The multiple cylinders of the engine 10 belong to the first or second cylinder group. The multiple cylinders are classified into the first or second cylinder group based on a crank angle section $S_{CA}$ set for each cylinder. FIG. 2 is a diagram for explaining the crank angle section $S_{CA}$. As shown in FIG. 2, the crank angle section $S_{CA}$ is set to a crank angle section at an advance side than an exhaust TDC (i.e., ATDC=0°) of which is an end point of the crank angle section $S_{CA}$. The exhaust TDC corresponds to boundary crank angle between an exhaust stroke and an intake stroke. Crank angle θ1 is a starting point of the crank angle section $S_{CA}$. The crank angle θ1 is set to crank angle at which a variation in volume of an combustion chamber of the engine per crank angle is less than a predetermined value (e.g., ATDC=−20°).

Here, a classification method of the multiple cylinders will be described focusing on a # k cylinder of the engine 10 ("k" is a natural number which is less than or equal to total number of the multiple cylinders). First, the crank angle section $S_{CA}$ having crank angle at which the exhaust stroke of the # k cylinder ends is set. Subsequently, it is judged whether or not initial combustion of the mixed gas in the # k cylinder occurs after passing through the crank angle section $S_{CA}$. Here, "initial combustion" means that the ignition of the mixed gas in the # k cylinder is performed initially by the first discharge action in # k cylinder.

The judgement of this passage is performed based on stopping crank angle of the # k cylinder before the start of the cranking and a first start timing of the first discharge action in the # k cylinder after the start of the cranking. When it is judged that the initial combustion occurs after passing through the crank angle section $S_{CA}$, the # k cylinder is classified into the first cylinder group. When it is judged that the initial combustion occurs before passing through the crank angle section $S_{CA}$, the # k cylinder is classified into the second cylinder group.

2.2 Examples of Start Control

2.2.1 First Example

Figure 3:
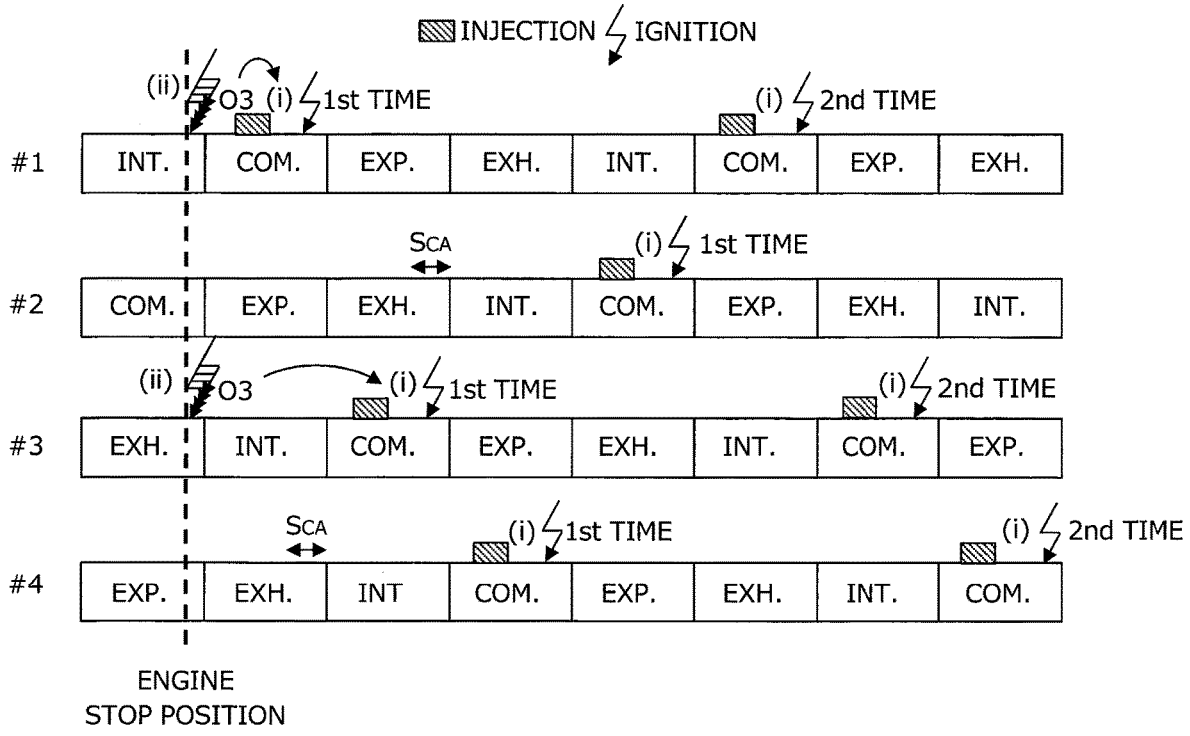
FIG. 3 is a diagram for explaining a first example of start control.

FIG. 3 is a diagram for explaining a first example of the start control. In FIG. 3, cycles of the engine having #1 to #4 cylinders are drawn over two cycles. Intake strokes of the #1 to #4 cylinders occur in the order of the #1, #3, #4 and #2 cylinders. On the left side of FIG. 3, a stop position of the engine is drawn. In other words, in the first example, a piston of the #1 cylinder stops in the middle of the intake stroke, the piston of the #2 cylinder stops in the middle of the compression stroke (COM.), the piston of the #3 cylinder stops in the middle of the exhaust stroke (EXH.), and the piston of the #4 cylinder stops in the middle of the expansion stroke (EXP.).

In the first example, the #1 and #3 cylinders are classified into the first cylinder group. Therefore, in the #1 and #3 cylinders, the second discharge action (ii) is performed before the first time of the first discharge action (i). In the first example, the second discharge action (ii) is performed at the stop position of the engine. This indicates that the second discharge action (ii) is performed before the start of the cranking. After the second discharge action (ii) is performed, the cranking is started. After the start of the cranking, fuel is injected immediately before the first discharge action (i). Then, in the first time of the first discharge action (i), the ozone (O3) which was generated by the second discharge action (ii) is consumed together with the mixed gas.

In the first example, the #2 and #4 cylinders are classified into the second cylinder group. Therefore, in the #2 and #4 cylinders, the second discharge action (ii) is not performed before the first time of the first discharge action (i). This is because that, in the #2 and the #4 cylinders, the crank angle section $S_{CA}$ exists between the stop position of the engine and a position at which the first time of the first discharge action (i) is performed. Therefore, in the #2 and #4 cylinders, fuel is injected immediately before the first discharge action (i), and only the mixed gas is consumed in the first discharge action (i).

2.2.2 Second Example

Figure 4:
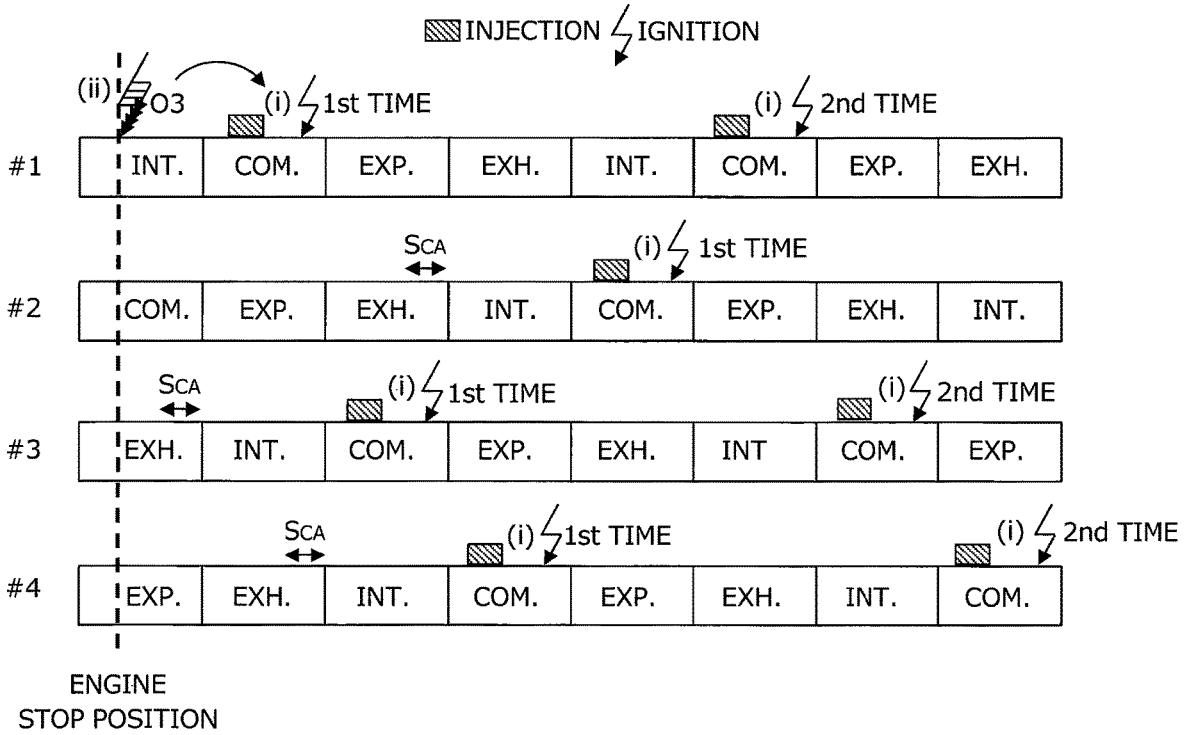
FIG. 4 is a diagram for explaining a second example of the start control.

FIG. 4 is a diagram for explaining a second example of the start control. Similar to FIG. 3, FIG. 4 draws the cycles of the engine including #1 to #4 cylinders over two cycles. The order of the occurrence of the intake strokes of the #1 to #4 cylinders drawn in FIG. 4 is the same as that in FIG. 3. On the left side of FIG. 4, the stop position of the engine is drawn. In other words, in the second example, the piston of the #1 cylinder stops in an anterior half of the intake stroke, the piston of the #2 cylinder stops in a posterior half of the compression stroke, the piston of the #3 cylinder stops in the anterior half of the exhaust stroke, and the piston of the #4 cylinder stops in the posterior half of the expansion stroke.

In the second example, only the #1 cylinder is classified into the first cylinder group. Therefore, in the #1 cylinder, the second discharge action (ii) is performed before the first time of the first discharge action (i). After the second discharge action (ii) is performed, the cranking is started. After the start of the cranking, fuel is injected immediately before the first discharge action (i). Then, in the first time of the first discharge action (i), the ozone which was generated by the second discharge action (ii) is consumed together with the mixed gas.

The second example differs from the first example in that the #3 cylinder is classified into the second cylinder group. The reason for this is the stop position of the piston of the #3 cylinder. In the second example, the piston of the #3 cylinder is stopped in the anterior half of the exhaust stroke. Therefore, in the #3 cylinder, the first time of the first discharge action (i) is performed after passing through the crank angle section $S_{CA}$. Therefore, the #3 cylinder is classified into the second cylinder group, and in the #2 to #4 cylinders, the second discharge action (ii) is not performed before the first discharge action (i).

2.2.3 Comparative Example

Figure 5:
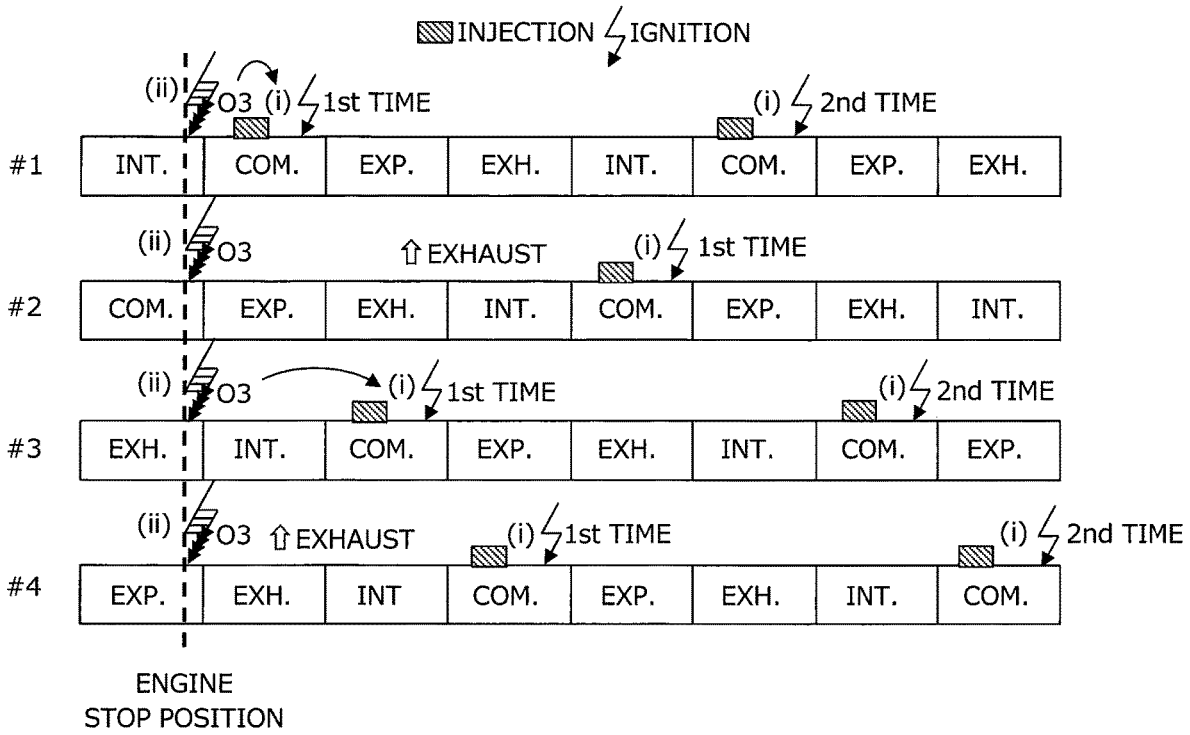
FIG. 5 is a diagram for explaining a comparative example of the start control.

FIG. 5 is a diagram for explaining a comparative example of the start control. Similar to FIG. 3, FIG. 5 draws the cycles of the engine including #1 to #4 cylinders over two cycles. The order of the occurrence of the intake strokes of the #1 to #4 cylinders drawn in FIG. 5 is the same as that in FIG. 3. The stop position of the engine drawn in FIG. 5 is the same as that in FIG. 3.

Unlike the first example described in FIG. 3, in this comparative example, the second discharge action (ii) is performed before the first time of the first discharge action (i) in every cylinder. Then, in the #1 and #3 cylinders, the ozone is consumed at the first time of the first discharge action (i), whereas the ozone is discharged from the #2 and #4 cylinders before the first time of the first discharge action (i).

3. Stop Control

The engine control executed by the ECU 20 includes control at the stop of the engine 10 (hereinafter also referred to as "stop control"). The term "stop" in the present disclosure includes both manual stop and automatic stop. The stop control is not control that is executed alone but is executed on an assumption that the start control will be executed in the future. In the stop control, the ignition apparatus 12 and the injector 14 are temporarily driven before their stop.

In the stop control, the ignition apparatus 12 and the injector 14 of a predetermined cylinder are driven such that the piston of the predetermined cylinder is stopped within the crank angle section $S_{CA}$ which is set with respect to the predetermined cylinder. The predetermined cylinder may be selected arbitrarily or may be selected based on an assessment function which is previously prepared. For example, the assessment function is designed to use cumulative number of times of the second discharge action as its variable, and the cylinder with small cumulative number of times is preferentially selected as the predetermined cylinder. For another example, the assessment function is designed to use as its variable a parameter which is changed in accordance with combustion state (e.g., rotation fluctuation rate), and the cylinder with relatively low evaluation of this parameter is preferentially selected as the predetermined cylinder.

2.3 Specific Processing

Figure 6:
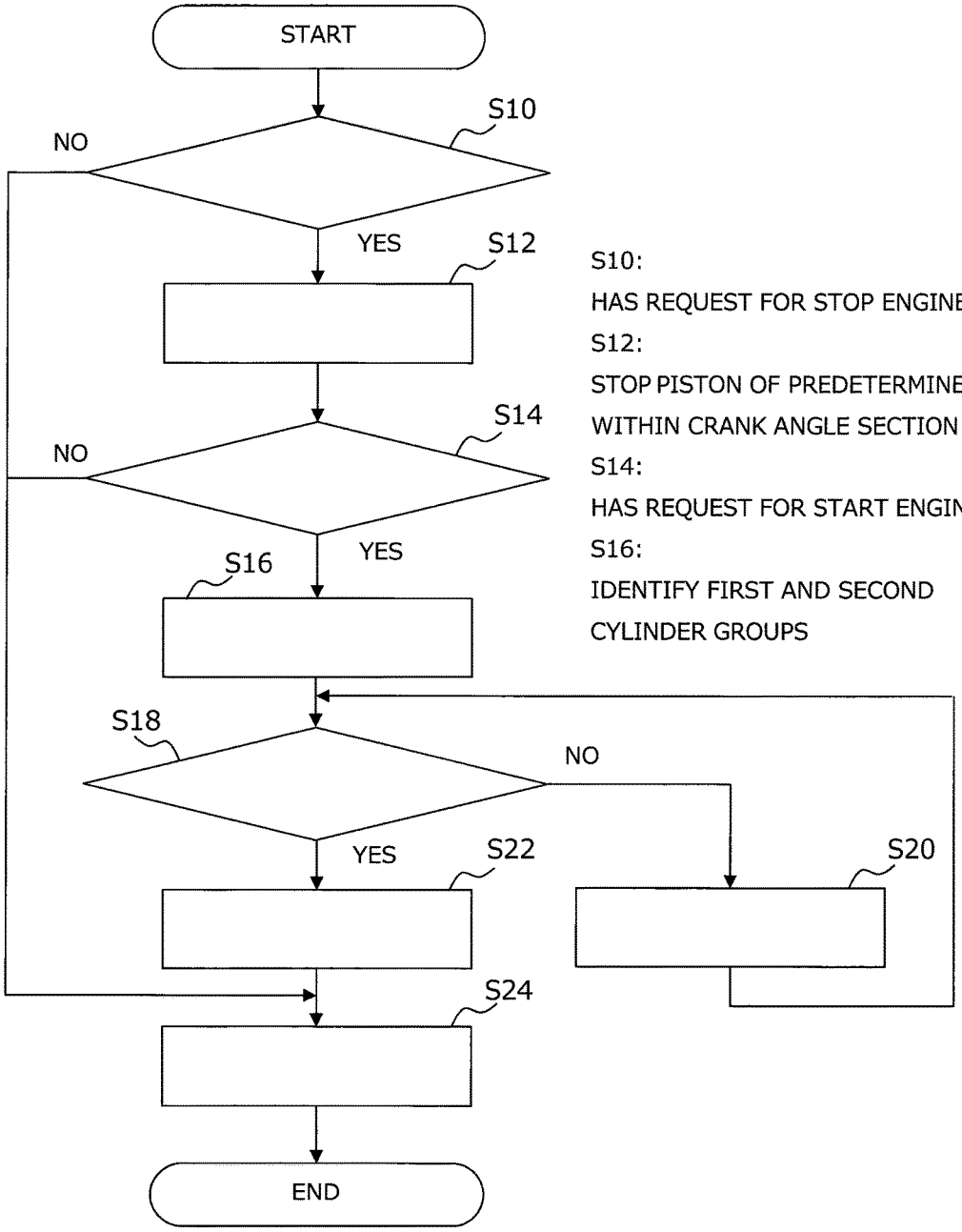
FIG. 6 is a flow chart for explaining processing flow when stop control and the start control are executed.

FIG. 6 is a flowchart for explaining processing flow when the ECU 20 executes the stop control and the start control. The processing flow when the ECU 20 executes only the start control is described in the steps S14 to S24. The routine shown in FIG. 6 is repeatedly executed at a predetermined control cycle.

In the routine shown in FIG. 6, first, it is judged whether or not a request for stop the engine 10 has issued (step S10). When an ignition switch is turned from ON to OFF, it is judged that the request for stop (the manual request for stop) is issued. Even when the ignition switch is ON, for example, when the following conditions (i) to (iii) are satisfied, it is judged that the request for stop (the automatic request for stop) is issued.

(i) Speed of the vehicle is less than a predetermined speed (>0)

(ii) An accelerator pedal is not depressed (iii) Stepped amount of a brake pedal is more than a threshold When the judgment result of the step S10 is positive, the piston of the predetermined cylinder is stopped within the crank angle section $S_{CA}$ which is set with respect to the predetermined cylinder (step S12). The position of the piston of the predetermined cylinder is detected, for example, based on the crank angle in 720° CA system obtained from the crank position sensor.

Subsequent to the step S12, it is judged whether or not a request for start the engine 10 has issued (step S14). When the ignition switch is turned from OFF to ON, it is judged that the request for start is issued. Alternatively, when any one of the conditions (i) to (iii) mentioned above is not satisfied under a condition where the ignition switch is ON, it is judged that the request for start is issued.

When the judgment result of the step S14 is positive, the first and second cylinder groups are identified (step S16). The identification of the first and second cylinder groups is performed, for example, by applying the crank angle in the 720° CA system to the classification method mentioned above. Note that a timing at which the initial combustion occurs is calculated with reference to a timing at which the first discharge action is started in an initial combustion cylinder (e.g., a timing at which the crankshaft rotates 90° CA from the stop position). Here, the "initial combustion" means that the ignition of the mixed gas is performed initially among all cylinders by the first discharge action performed immediately after the start of the cranking.

After the identification of the first and second cylinder groups, it is judged whether a specified time has elapsed (step S18). The specified time is a sufficient time for the second discharge action to be performed at least once. The specified time may be a fixed time. When the predetermined cylinder is selected based on the assessment function mentioned above, the specified time may be changed according to the assessment result. When the judgment result in the step S18 is negative, the second discharge action is performed in the cylinder which is classified into the first cylinder group (step S20). The processes of the steps S18 and S20 are repeated until the positive judgment result is obtained in the step S18.

If the judgment result in the step S18 is positive, the cranking is started (step S22). Subsequently, the first discharge action is performed in every cylinder, and fuel supply to every cylinder is performed (step S24).

5. Advantageous Effects by Start Control

According to the start control mentioned above, in the cylinder which is classified into the second cylinder group, it is possible to improve the combustion state of the same cylinder by using the ozone generated before the start of the cranking. In addition, since no unnecessary ozone is generated in the cylinder which is classified into the first cylinder group, it is possible to reduce number of times to drive the ignition apparatus which is driven for generating the ozone. Therefore, it is possible to prevent the life of the ignition apparatus 12 of the cylinder which is classified into the first cylinder group from being shorten.

In addition, according to the stop control, the piston of the predetermined cylinder is stopped the crank angle section $S_{CA}$ which is set with respect to the predetermined cylinder. Therefore, by the combination of the stop control and the start control, it is possible to improve the combustion state of the predetermined cylinder definitely.

4. Other Embodiments

In the start control mentioned above, the second discharge action was performed before the start of the cranking. However, in the cylinder which is classified into the second cylinder group, the second discharge action may be performed within a crank angle section from a crank angle at which the cranking starts to a crank angle at which the fuel is injected in the same cylinder. In other words, the second discharge action may be performed after the start of the cranking and also before the fuel injection in the cylinder which is classified into the second cylinder group. When the second discharge action is performed at such a period, it is possible to improve the combustion state in the cylinder which is classified into the second cylinder group by using the ozone.

In the start control described above, the second discharge action was performed only before the start of the cranking. However, the second discharge action may be performed in every cylinder after second time of the first discharge action. In this case, the ignition apparatuses 12 may be driven in the same cycle to perform the first discharge action prior to the second discharge action.

Note that, even when the embodiment described above mentions about a value such as number, quantity, amount and range, the present disclosure is not limited by the referred values unless the value is explicitly referred in the present disclosure or clearly specified to the value in principle. In addition, the configuration and the steps of the embodiment described above is not essential to the present disclosure unless explicitly referred in the present disclosure or clearly specified to the configuration in principle.

What is claimed is:

1. A control system for internal combustion engine, comprising:

an internal combustion engine including multiple cylinders;

ignition apparatuses which are provided to each of the multiple cylinders; and a controller which is configured to control discharge actions of the ignition apparatuses for each cylinder, wherein the discharge actions include a first discharge action for igniting mixed gas in the multiple cylinders and a second discharge action for generating ozone, wherein the controller is further configured to perform start control of the internal combustion engine, wherein, in the start control, the controller is configured to:

classify the multiple cylinders into a first group or a second cylinder group;

control the ignition apparatus of at least one cylinder of the multiple cylinders which is classified into the first cylinder group such that the second discharge action is not performed before the start of the first discharge action; and control the ignition apparatus of at least one cylinder of the multiple cylinders which is classified into the second cylinder group such that the second discharge action is performed before the start of the first discharge action, wherein the at least one cylinder which belongs to the first cylinder group is at least one cylinder of the multiple cylinders in which an initial combustion of the mixed gas occurs after passing through a crank angle section which is set on an end side of an exhaust stroke of the same cylinder, wherein the at least one cylinder which belongs to the second cylinder group is at least one cylinder of the multiple cylinders in which the initial combustion of the mixed gas occurs before passing through a crank angle section which is set on the end side of the exhaust stroke of the same cylinder.

2. The control system according to claim 1, further comprising injectors which are configured to supply fuel into each of the multiple cylinders, wherein the controller is further configured to perform stop control of the internal combustion engine, wherein, in the stop control, the controller is configured to control the ignition apparatus and the injector of a predetermined cylinder of the multiple cylinders such that a piston of the predetermined cylinder stops in a crank angle section which is set on the end side of the exhaust stroke of the predetermined cylinder, wherein, in the start control, the controller is configured to control the ignition apparatus of the predetermined cylinder such that the first discharge action in the predetermined cylinder starts before passing through the crank angle section which is set on the end side of the exhaust stroke of the predetermined cylinder.

* * * * *